US006953352B2

(12) United States Patent
Karell

(10) Patent No.: US 6,953,352 B2
(45) Date of Patent: Oct. 11, 2005

(54) ELECTRICAL CONNECTION FOR FUEL INJECTORS

(75) Inventor: Erik K. Karell, Commerce Township, MI (US)

(73) Assignee: Siemens VDO Automotive Inc., Chatham (CA)

( * ) Notice: Subject to any disclaimer, the term of this patent is extended or adjusted under 35 U.S.C. 154(b) by 485 days.

(21) Appl. No.: 09/844,938

(22) Filed: Apr. 27, 2001

(65) Prior Publication Data

US 2002/0049007 A1 Apr. 25, 2002

Related U.S. Application Data

(60) Provisional application No. 60/242,873, filed on Oct. 24, 2000.

(51) Int. Cl.[7] ..... H01R 13/44

(52) U.S. Cl. ..... 439/130; 439/877; 439/424

(58) Field of Search ..... 439/421, 422, 439/423, 424, 877, 130, 878, 426, 936, 874; 123/456, 468, 469, 470

(56) References Cited

U.S. PATENT DOCUMENTS

| | | | | | |
|---|---|---|---|---|---|
| 4,082,402 | A | * | 4/1978 | Kinkaid et al. | 439/422 |
| 4,106,836 | A | * | 8/1978 | Asick et al. | 439/422 |
| 4,570,601 | A | | 2/1986 | Ito et al. | |
| 4,832,620 | A | * | 5/1989 | Yamamoto | 439/422 |
| 5,137,468 | A | * | 8/1992 | Murakami | 439/422 |
| 5,326,273 | A | * | 7/1994 | Kamon et al. | 439/936 |
| 5,584,704 | A | * | 12/1996 | Romann et al. | 439/130 |
| 5,598,824 | A | * | 2/1997 | Treusch et al. | 439/130 |
| 5,667,389 | A | | 9/1997 | Kidd et al. | |
| 5,860,831 | A | * | 1/1999 | Roder et al. | 439/422 |
| 5,893,351 | A | * | 4/1999 | Akutagawa et al. | 123/470 |
| 5,954,533 | A | * | 9/1999 | Hatagishi et al. | 439/936 |
| 6,299,469 | B1 | | 10/2001 | Glovatsky et al. | |
| 6,308,685 | B1 | * | 10/2001 | Becker | 123/456 |

FOREIGN PATENT DOCUMENTS

| | | |
|---|---|---|
| DE | 32 20 090 A1 | 12/1983 |
| DE | 197 27 314 A1 | 1/1999 |

OTHER PUBLICATIONS

European Search Report dated May 16, 2003.

* cited by examiner

*Primary Examiner*—Tho D. Ta

(57) ABSTRACT

An electrical connection arrangement for a fuel injector includes an electrical interface that is supported by the fuel injector body portion. The electrical interface preferably includes at least one deformable connector member. During assembly, the deformable connector member is manipulated to piece through an insulation layer on a conductor and make an electrical connection with a conductive portion of the conductor. In one example, the connector members are crimped into position to provide an electrical coupling and a physical connection between the interface and the associated conductor. The preferred conductor is a flex cable.

23 Claims, 2 Drawing Sheets

ELECTRICAL CONNECTION FOR FUEL INJECTORS

CROSS REFERENCE TO RELATED APPLICATIONS

This application claims priority to U.S. Provisional Application No. 60/242,873, which was filed on Oct. 24, 2000.

BACKGROUND OF THE INVENTION

This invention generally relates to fuel injectors for use with internal combustion engines. More particularly, this invention relates to an electrical connection arrangement for such fuel injectors.

Fuel injectors are typically included as part of the arrangement for providing fuel to an internal combustion engine. Fuel injectors take a variety of forms but typically include at least some electronic components that require electrical power and/or signals for proper operation. Typical arrangements include wire harnesses and standard connectors for coupling the fuel injector components to a power source and other control devices on the vehicle.

There are a variety of problems associated with the conventional connection methods used for fuel injectors. Typical connectors include a plurality of male pins associated with the fuel injector and a cooperating set of female pins associated with a connector. The connector typically has an outer shell which facilitates making the connection. During assembly, however, it is not uncommon for some of the male or female pin portions to become bent or distorted. The typical connector housing shields these pins from view so that visual inspection of a proper connection is not possible. Additionally, conventional connection arrangements do not always provide a secure connection over time.

This invention provides an improved connection arrangement that facilitates more secure electrical and physical connections for coupling a fuel injector to other electrical components on a vehicle. This invention provides the advantages of a more secure connection, visual inspection capabilities, simplified manufacturing procedures and material cost savings.

SUMMARY OF THE INVENTION

In general terms, this invention is a fuel injector assembly that includes a body portion that houses the fuel injector components. An electrical interface portion is supported by the body portion. At least one deformable connector member is supported on the interface portion. The deformable connector member has at least one edge that is adapted to penetrate an insulation covering on an electrical conductor to thereby electrically couple the connector portion to the electrical conductor.

In the preferred arrangement, the conductor is a flex cable and there are a plurality of deformable connector members that are crimped into connection with the conductive part of the flex cable.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
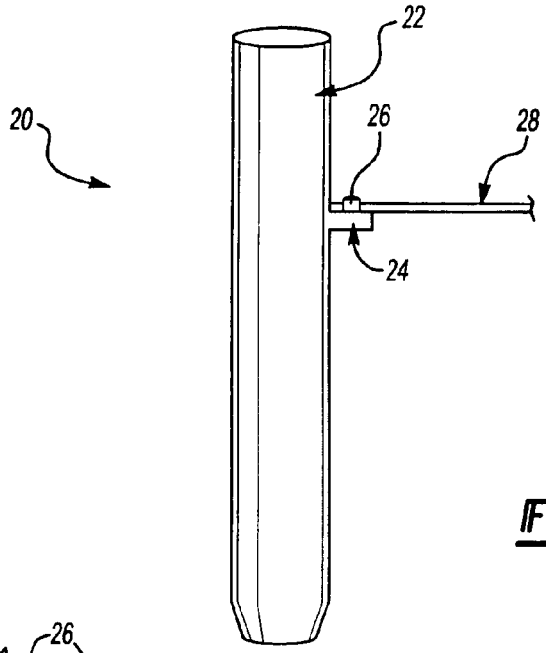
FIG. 1 schematically illustrates a fuel injector assembly designed according to this invention.
Figure 2:
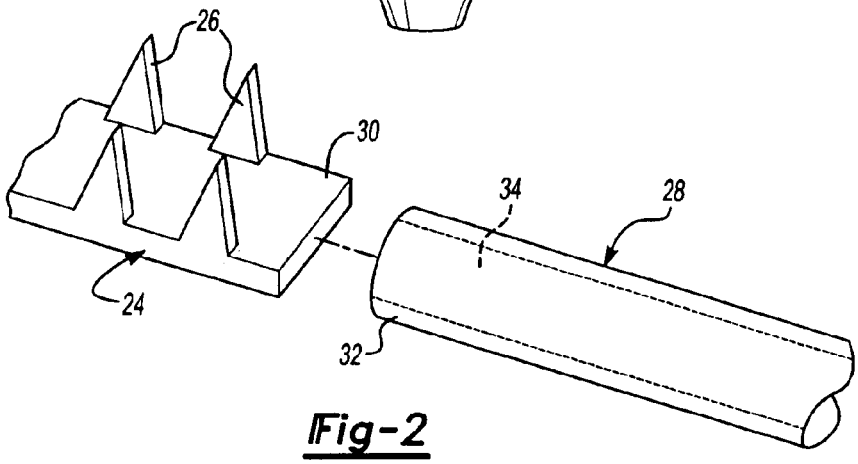
FIG. 2 is a partial, perspective, exploded view of selected components of the embodiment of FIG. 1.
Figure 3:
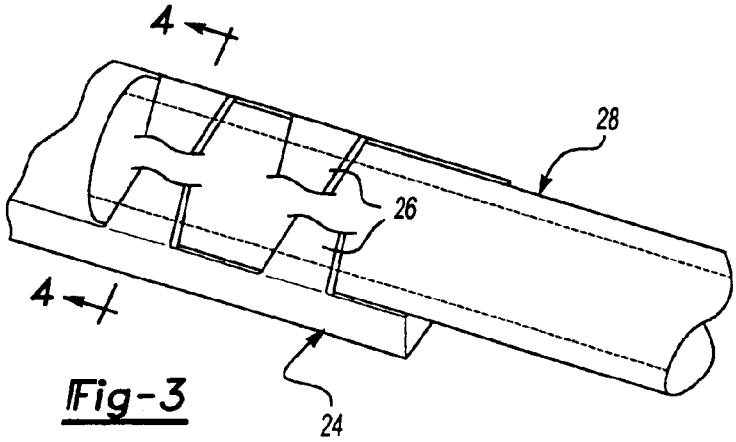
FIG. 3 illustrates the components of FIG. 2 in an assembled condition.

A fuel injector assembly 20 includes a generally conventional fuel injector body portion 22. An electrical interface 24 includes at least one connector member 26 to facilitate electrically coupling selected components of the fuel injector to other devices on a vehicle, such as an electronic controller and a power source, for example. An electrical conductor 28 permits communication of such electrical signals or power as needed.

The electrical connection interface 24 preferably includes a support portion 30 that receives and supports a portion of the conductor 28 during an assembly process. Once the conductor 28 is positioned relative to the interface 24, the connector members 26 preferably are deformed so that at least one portion of each connector member penetrates through an insulation layer 32 on the conductor 28 and forms an electrical coupling with a conductive portion 34 of the conductor 28. In the illustrated example, the connector members 26 are barbs with pointed edges that pierce through the insulation layer 32 and engage the conductive portion 34. In the illustrated arrangement, it is preferred to crimp the connector members 26 into the position shown in FIG. 4, for example, where a secure physical and electrical connection has been made between the interface 24 and the conductor 28.

Figure 5:
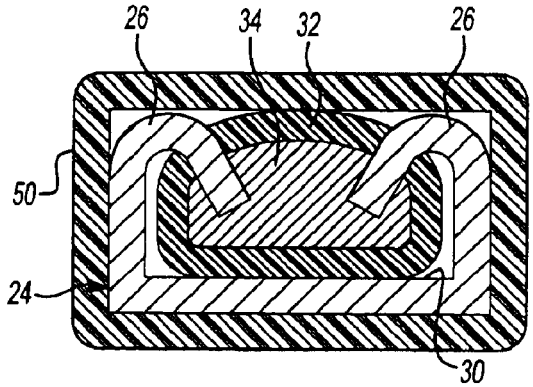
FIG. 5 illustrates another example embodiment from a cross sectional view.

Once an appropriate connection has been made, it is preferred to include a covering over at least a portion of the connecting interface 24 and an associated portion of the conductor 28. FIG. 5 illustrates an example covering 50, which preferably covers over the entire connecting interface 24 and an associated portion of the conductor 28. In one example, the covering 50 is molded plastic that is applied after the appropriate electrical connection has been made. In another example, the covering 50 is a seal that is applied to not only cover over the connecting interface 24 but also to provide a seal along the associated region of the fuel injector body 22 to prevent any contaminants from entering an opening in the body portion 22 adjacent the interface 24. Other example coverings 50 include foam or silicone type materials. The purpose of the covering 50 is to prevent wear or deterioration over time due to environmental exposure.

Figure 4:
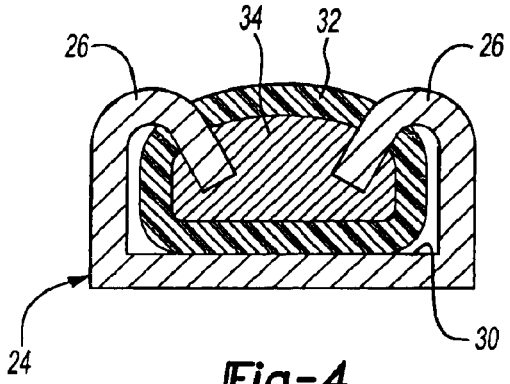
FIG. 4 is a cross sectional view taken along the lines 4—4 in FIG. 3.
Figure 6:
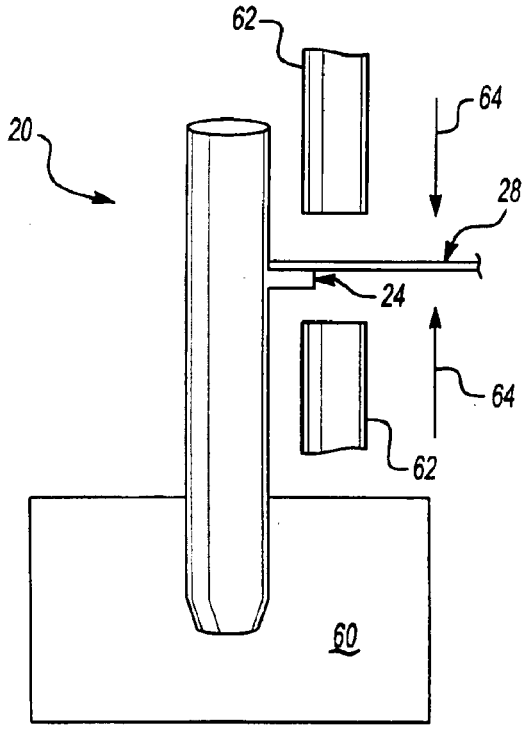
FIG. 6 schematically illustrates machinery for making an electrical connection according to this invention.

FIG. 6 schematically illustrates machinery 60 for holding a fuel injector in place during the assembly procedure according to this invention. Crimping members 62 preferably move as shown by the arrow 64 into position to deform the connector portions 26 into a position where a proper electrical and physical coupling is made. In the illustrated example, the crimping members 62 crimp the barb portions 26 into a position as shown in FIG. 4, for example.

The preceding description is exemplary rather than limiting in nature. For example, a single conductor with a plurality of connector members has been illustrated. Of course, this invention is applicable to fuel injector arrangements having multiple electrical conductors that are coupled with fuel injector components. Each conductor member may include a plurality of connector members, but at least one is preferred. Other variations and modifications to the disclosed example may become apparent to those skilled in the art that do not necessarily depart from the essence of this invention. The scope of legal protection given to this invention can only be determined by studying the following claims.

What is claimed is:

1. A fuel injector assembly, comprising:

a body portion that houses fuel injector components;

an electrical interface portion supported by the body portion; and at least one deformable connector means supported on the interface portion, the deformable connector means having at least one edge for piercing and penetrating through an insulation covering on an electrical conductor to thereby electrically couple the interface portion to the electrical conductor.

2. The assembly of claim 1, wherein the electrical interface portion at least partially extends outwardly and away from the body portion and the deformable connector member is outside of the body portion.

3. The assembly of claim 1, wherein the connector means establishes a mechanical connection between the interface portion and the conductor.

4. The assembly of claim 1, wherein the connector means includes a plurality of connector members, each comprising a barb of flexible metal material.

5. The assembly of claim 4, wherein the plurality of connector members make electrical contact with a single electrical conductor.

6. A fuel injector assembly, comprising:

a body portion that houses fuel injector components;

an electrical interface portion supported by the body portion;

at least one deformable connector member supported on the interface portion; and at least one electrical conductor having an insulation covering on a conductive portion, the deformable connector member having at least one edge piercing through the insulation covering and making electrical contact with the electrical conductor.

7. The assembly of claim 6, wherein the conductor comprises a flexible conductor cable.

8. The assembly of claim 6, including a plurality of conductors and a corresponding plurality of deformable connector members.

9. The assembly of claim 6, wherein the conductor comprises a flex cable.

10. The assembly of claim 6, wherein the connector member establishes a physical connection between the interface portion and the conductor.

11. The assembly of claim 6, including a plurality of connector members, each comprising a barb of flexible metal material.

12. The assembly of the plurality of connector members make electrical contact with a single conductor.

13. The assembly of claim 6, including a securing member placed over the conductor and the connector member.

14. The assembly of claim 6, wherein the securing member comprises plastic that is molded over the conductor and the connector member.

15. The assembly of claim 13, wherein the securing member comprises a seal.

16. The assembly of claim 13, wherein the securing member comprises at least one material selected from the group consisting of plastic, foam or silicone.

17. A method of making an electrically conductive connection between an electrical interface on a fuel injector that has at least one deformable connector member and an electrical conductor, comprising the steps of:

positioning a portion of the conductor near the deformable connector member; and deforming the deformable connector member to pierce through an insulation covering on the conductor and to establish an electrically conductive connection between the electrical interface and the conductor.

18. The method of claim 17, including crimping the deformable member onto the conductor.

19. The method of claim 17, including at least partially penetrating the conductor with a portion of the deformable connector member to establish an electrically conductive coupling through the deformable connector member.

20. The method of claim 17, including physically securing the fuel injector interface to the conductor when deforming the deformable connector member.

21. The method of claim 17, including covering the deformable connector member and an associated portion of the conductor after performing the deforming step.

22. The method of claim 21, including molding a plastic material onto the connector member and the associated portion of the conductor.

23. The method of claim 21, including placing a seal over the connector member and the associated portion of the conductor.

* * * * *